US010307811B2

(12) United States Patent
Huang

(10) Patent No.: US 10,307,811 B2
(45) Date of Patent: Jun. 4, 2019

(54) APPARATUS FOR PROTECTIVELY HOLDING AN ELONGATED OBJECT DURING BENDING AND STRETCHING OF THE ELONGATED OBJECT

(71) Applicant: Industro International Co., Ltd., Taichung (TW)

(72) Inventor: Kuo-Chan Huang, Taichung (TW)

(73) Assignee: INDUSTRO INTERNATIONAL CO., LTD., Taichung (TW)

( * ) Notice: Subject to any disclaimer, the term of this patent is extended or adjusted under 35 U.S.C. 154(b) by 350 days.

(21) Appl. No.: 15/370,988

(22) Filed: Dec. 6, 2016

(65) Prior Publication Data

US 2018/0154424 A1 Jun. 7, 2018

(51) Int. Cl.

| | |
|---|---|
| ***B21D 7/06*** | (2006.01) |
| ***B21D 43/00*** | (2006.01) |
| ***B21K 1/54*** | (2006.01) |
| ***B21D 7/16*** | (2006.01) |

(52) U.S. Cl.
CPC ..... *B21D 43/006* (2013.01); *B21D 7/16* (2013.01); *B21K 1/54* (2013.01)

(58) Field of Classification Search
CPC ..... B21D 43/006; B21D 7/16; B21K 1/54
USPC ..... 72/428
See application file for complete search history.

(56) References Cited

U.S. PATENT DOCUMENTS 6,481,260 B2 * 11/2002 Jung ..... B21D 15/04 72/353.4
8,037,733 B2 * 10/2011 Banas ..... A61F 2/91 72/370.04
8,336,360 B1 * 12/2012 Lee ..... B21D 17/02 72/370.04

* cited by examiner

*Primary Examiner* — David B Jones
(74) *Attorney, Agent, or Firm* — Bruce Stone LLP; Joseph A. Bruce

(57) ABSTRACT

An apparatus is provided for protectively hold an elongated object during bending and stretching of the elongated object. The apparatus includes a shell, sleds and roller sets. The shell includes a wall, support portions longitudinally extending on an internal face of the wall, and grooves separated from one another by the support portions. Each of the sleds is inserted in a corresponding one of the grooves. Each of the roller sets includes rollers attached to a corresponding one of the sleds. Each of the rollers includes a tread. The treads together provide an axial tunnel. A surface of the elongated object is in contact with the concave treads of the rollers when the elongated object is rolled in the axial tunnel during bending or stretching of the elongated object.

15 Claims, 10 Drawing Sheets

APPARATUS FOR PROTECTIVELY HOLDING AN ELONGATED OBJECT DURING BENDING AND STRETCHING OF THE ELONGATED OBJECT

BACKGROUND OF INVENTION

1. Field of Invention

The present invention relates to deformation of an elongated object and, more particularly, to an apparatus for protectively holding an elongated object during bending and stretching of the elongated object.

2. Related Prior Art

It is sometimes desired to bend an elongated object such as a rod and a tube. For example, a straight plastic tube can be heated and softened before it is bent. A bent plastic tube can be heated and soften before it is stretched. However, such heating is often not even so that a portion of a plastic tube is excessively soft while another portion of the plastic tube is excessively hard. It is troublesome to bend or stretch the portion of the plastic tube that is excessively soft or hard.

A straight metal tube can be bent by forging or another proper method for fabrication in a mechanical or hydraulic mold. For example, Taiwan Patent Application Publication No. 353988 discloses a mold 10 for use with a machine 6 to bend a tube 5. The mold 10 includes a desired number of pairs of semi-circular leaf springs 1 and 2 provided on two rods 3 and 4 so that the mold 10 is flexible. The tube 5 is inserted in the mold 10 before the tube 5 is bent by the machine 6. The leaf springs 1 and 2 can be removed from the flexible rods 3 and 4 after the tube 5 is bent by the machine 6. However, the use of the mold 10 is not without any problem. Firstly, it is troublesome to place the pairs of leaf springs 1 and 2 on the flexible rods 3 and 4 or remove the pairs of leaf springs 1 and 2 from the flexible rods 3 and 4 because of the large number of pairs of leaf springs 1 and 2. Secondly, the tube 5 might be scratched by some of the leaf springs 1 and 2.

The present invention is therefore intended to obviate or at least alleviate the problems encountered in prior art.

SUMMARY OF INVENTION

It is the primary objective of the present invention to provide an apparatus for protectively holding an elongated object during bending and stretching of the elongated object.

To achieve the foregoing objective, the apparatus includes a shell, sleds and roller sets. The shell includes a wall, support portions longitudinally extending on an internal face of the wall, peripheral tunnels each extending in a corresponding one of the support portions, and grooves separated from one another by the support portions. Each of the sleds is inserted in a corresponding one of the grooves. Each of the roller sets includes rollers attached to a corresponding one of the sleds. Each of the rollers includes a tread. The treads together provide an axial tunnel. A surface of the elongated object is in contact with the concave treads of the rollers when the elongated object is rolled in the axial tunnel during bending or stretching of the elongated object.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
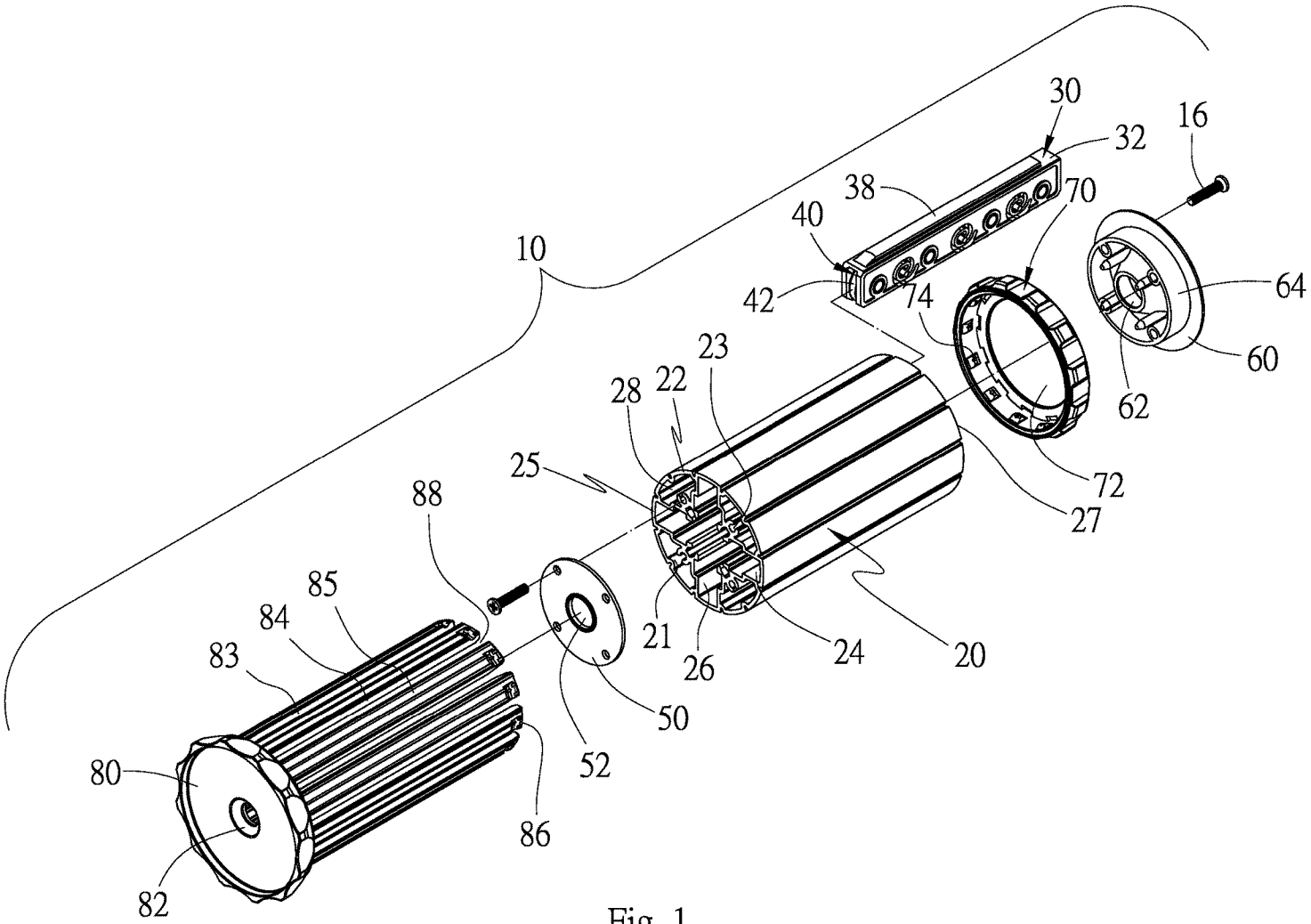
FIG. 1 is an exploded view of an apparatus for protectively holding an elongated object during bending and stretching of the elongated object according to the first embodiment of the present invention.
Figure 2:
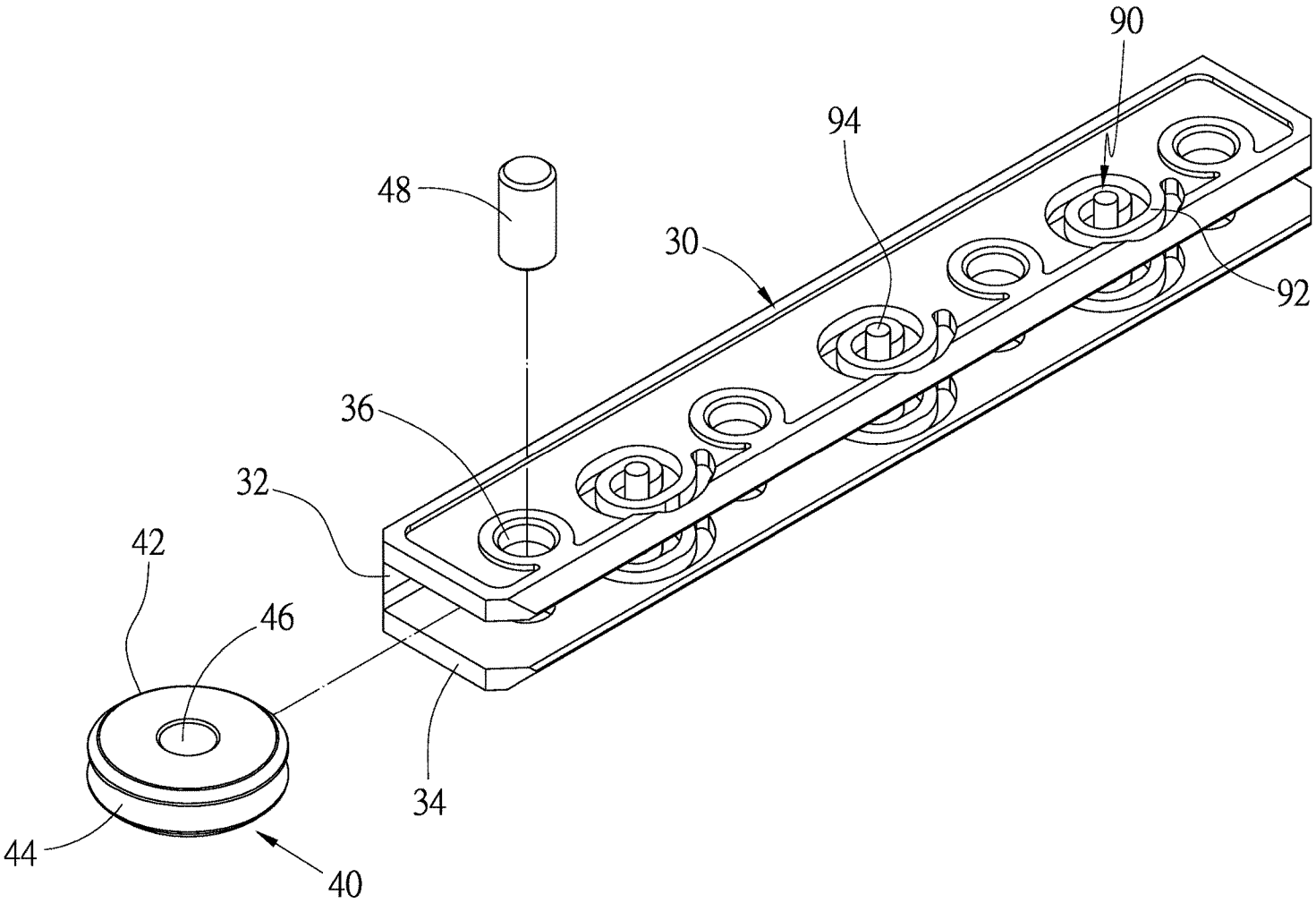
FIG. 2 is an enlarged partial view of the apparatus shown in FIG. 1.

Referring to FIGS. 1 through 8, there is an apparatus 10 for protectively holding an elongated object during bending and stretching of the elongated object. The apparatus 10 includes a shell 20, four sleds 30, four roller sets 40, two rings 50 and 60, a lock 70 and a cover 80 according to a first embodiment of the present invention.

The shell 20 is preferably made of aluminum by extrusion and includes a wall 22, four ribs 21 and four support portions 24. The ribs 21 are evenly arranged and extend on an internal face of the wall 22. The support portions 24 are also evenly arranged and extend on the internal face of the wall 22. Each support portion 24 includes a peripheral tunnel 28 made therein. Each support portion 24 includes two faces extending parallel to each other on the outside and two flanges 29 each extending on a corresponding face. Each rib 21 is located in a corresponding peripheral tunnel 28. The wall 22 and the support portions 24 together provide a longitudinal space separated from the peripheral tunnels 28. The longitudinal space looks like an "X" in a cross-sectional view, i.e., it includes four grooves 26 in communication with an axial tunnel 14.

The shell 20 includes, at a first end 25, four screw holes 23 each made in a corresponding support portion 24. The shell 20 includes, at the second end 27, four more screw holes 23 each made in a corresponding support portion 24.

Each sled 30 includes a back portion 32, two flank portions 34 and a fin 38. The back portion 32 is formed on the flank portions 34. Each flank portion 34 includes four apertures 36. The fin 38 is formed on the back portion 32.

Each roller set 40 includes four rollers 42 and four axles 48. Each roller 42 includes a concave tread 44 and an axial aperture 46. The rollers 42 of each roller set 40 are placed between the flank portions 34 of a corresponding sled 30. Each axle 48 is inserted the axial aperture 46 of a corresponding roller 42 and a corresponding aperture 36 of a corresponding flank portion 34, thereby connecting each roller set 40 to a corresponding sled 30.

Each sled 30 is movably inserted in a corresponding groove 26, between two corresponding support portions 24. The concave tread 44 together render the axial tunnel 14 circular in a cross-sectional view.

Each sled 30 further includes three elastic elements 90 for contact with two corresponding flanges 29 to keep the sled 30 in the corresponding groove 26. Each elastic element 90 includes a coil spring 92 and a rod 94. The coil spring 92 is formed on a corresponding flank portion 34 of a corresponding sled 30 by making a helical slot in the flank portion 34. The rod 94 extends transversely at an end of the coil spring 92. Each rod 94 includes two ends kept in contact with two corresponding flanges 29 because the rod 94 is biased by the corresponding coil spring 92 that is loaded. Each sled 30 is movable in two senses of a direction M in the corresponding groove 26. The coil springs 92 of each sled 30 are further loaded when the rollers 42 of the corresponding roller set 40 are moved deeper in the corresponding groove 26 under a force. The coil springs 92 of each sled 30 recover when the force stops.

The ring 50 includes a funnel-shaped portion 52 and several peripheral apertures (not numbered). The peripheral apertures are located around the funnel-shaped portion 52 of the ring 50.

The ring 60 includes a funnel-shaped portion 62 and an annular lip 64. The funnel-shaped portion 62 is formed at a center of the ring 60. The annular lip 64 extends around the funnel-shaped portion 62.

The lock 70 includes a circular opening 72 and bosses 74 formed on an internal face. The bosses 74 are preferably in the form of barbs.

The cover 80 includes a countersink hole 82 and four strip sets. The countersink hole 82 is centrally made in the cover 80. Each strip set includes three strips 83, strips 84 and 85. The strips 83, 84 and 85 extend from a face of the cover 80. The strips 83, 84 and 85 extend longer than the shell 20. The strips 83, 84 and 85 are separated from one another by slits 88. Each of the strips 83, 84 and 85 includes a groove 81 in an internal face of the back portion. Each of the strips 83, 84 and 85 includes a recess 86 in an external face of the back portion.

Figure 5:
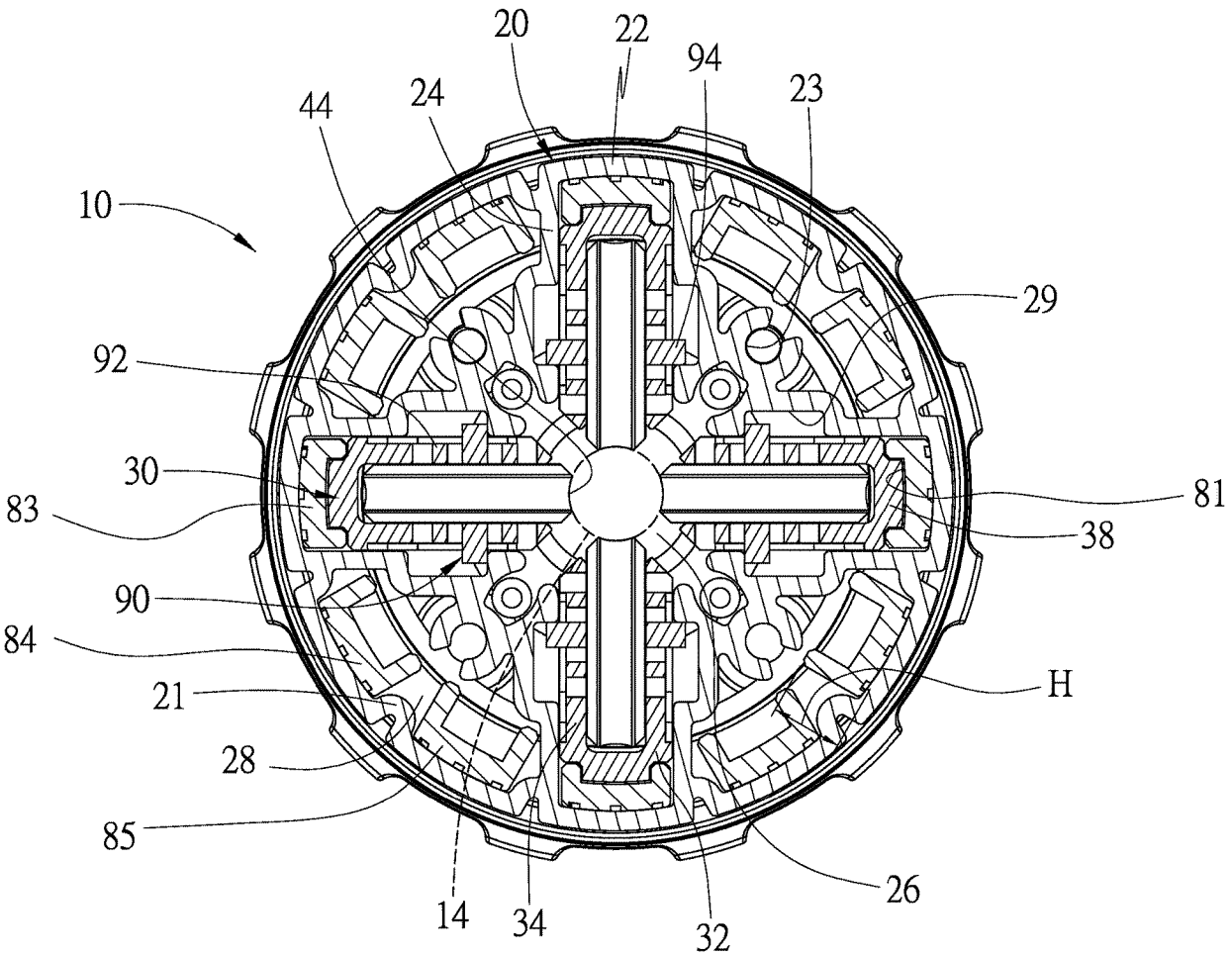
FIG. 5 is a cross-sectional view of the apparatus taken along a line A-A shown in FIG. 4.

Referring to FIG 5, each of the strips 83, 84 and 85 includes a back portion extending perpendicularly between two flank portions. The flank portions of each strip 83 are made with height H1. The flank portions of each strip 84 are made with height H2. The flank portions of each strip 85 are made with height H3. The height H1 is smaller than the height H2, and the height H2 is smaller than the height H3. Reasons for difference in the height of the flank portions of the strips 83, 84 and 85 are to be described.

Several screws 16 are inserted in the screw holes 23 at the first end 25 of the shell 20 via the ring 50, thereby detachably connecting the ring 50 to the first end 25 of the shell 20. The sleds 30 and the roller sets 40 are kept in the shell 20 by the ring 50. The funnel-shaped portion 52 of the ring 50 is communication with the axial tunnel 14.

Selectively, the fins 38 of the sleds 30 are inserted in the grooves 81 of the strips 83, 84 or 85 before the strips 83, 84 or 85 are inserted in the grooves 26. For example, the fins 38 are inserted in the grooves 81 of the strips 83 before the strips 83 are inserted in the grooves 26 and the strips 84 and 85 are inserted in the peripheral tunnels 28. Each of the ribs 21 is inserted in a selected one of the slits 88 so that the cover 80 cannot be rotated relative to the shell 20. Now, the recesses 86 are placed out of the shell 20. The sleds 30 are movable in a radial position of the shell 22 within a small range because the thickness of the strips 83 is marginally smaller than a gap between the wall 22 and the sleds 30. The cover 80 protects the ring 50 as the cover 80 is connected to the first end 25 of the shell 20. The countersink hole 82 of the cover 80 is in communication with the funnel-shaped portion 52 of the ring 50.

The lock 70 is placed at the second end 27 of the sell 20. The bosses 74 of the lock 70 can be inserted in the recesses 86 of the strips 83, 84 and 85 to lock the cover 80 to the lock 70. Thus, the cover 80 can be locked to the shell 20 by the lock 70.

Other screws 16 are inserted in the screw holes 23 at the second end 27 of the shell 20 via the ring 60, thereby detachably connecting the ring 60 to the second end 27 of the shell 20. The ring 60 retains the lock 70 near the second end 27 of the shell 20 but allows the lock 70 to rotate between a locking position and an unlocking position. The annular lip 64 is inserted in the circular opening 72 to guide the lock 70. The diameter of the funnel-shaped portion 62 gets smaller as the funnel-shaped portion 62 extends toward the cover 80.

Figure 3:
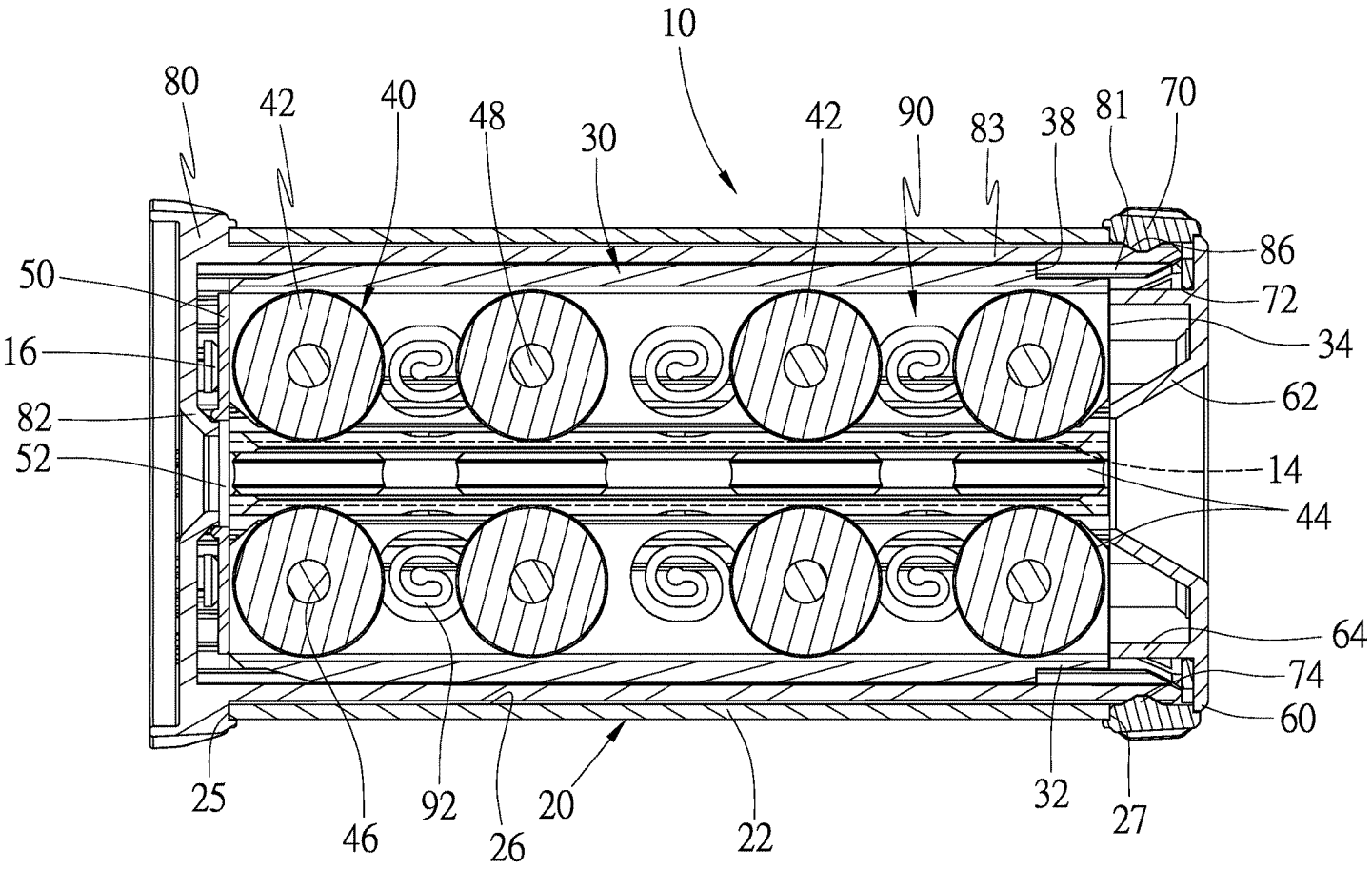
FIG. 3 is a cross-sectional view of the apparatus shown in FIG. 1.
Figure 6:
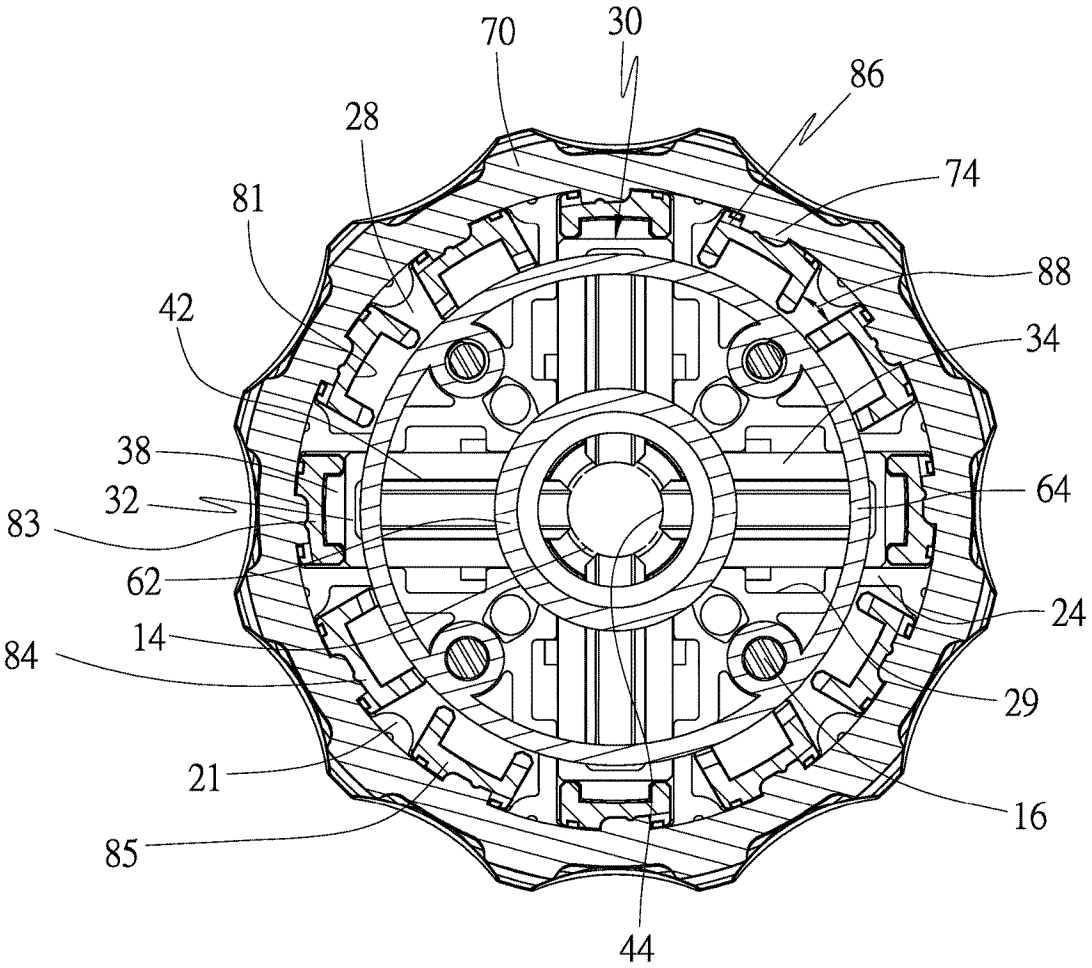
FIG. 6 is a cross-sectional view of the apparatus taken along a line B-B shown in FIG. 4.

Referring to FIGS. 3 and 6, the lock 70 is in the locking position. The bosses 74 are inserted in the recesses 86, thereby locking the cover 80 to the shell 20.

Figure 4:
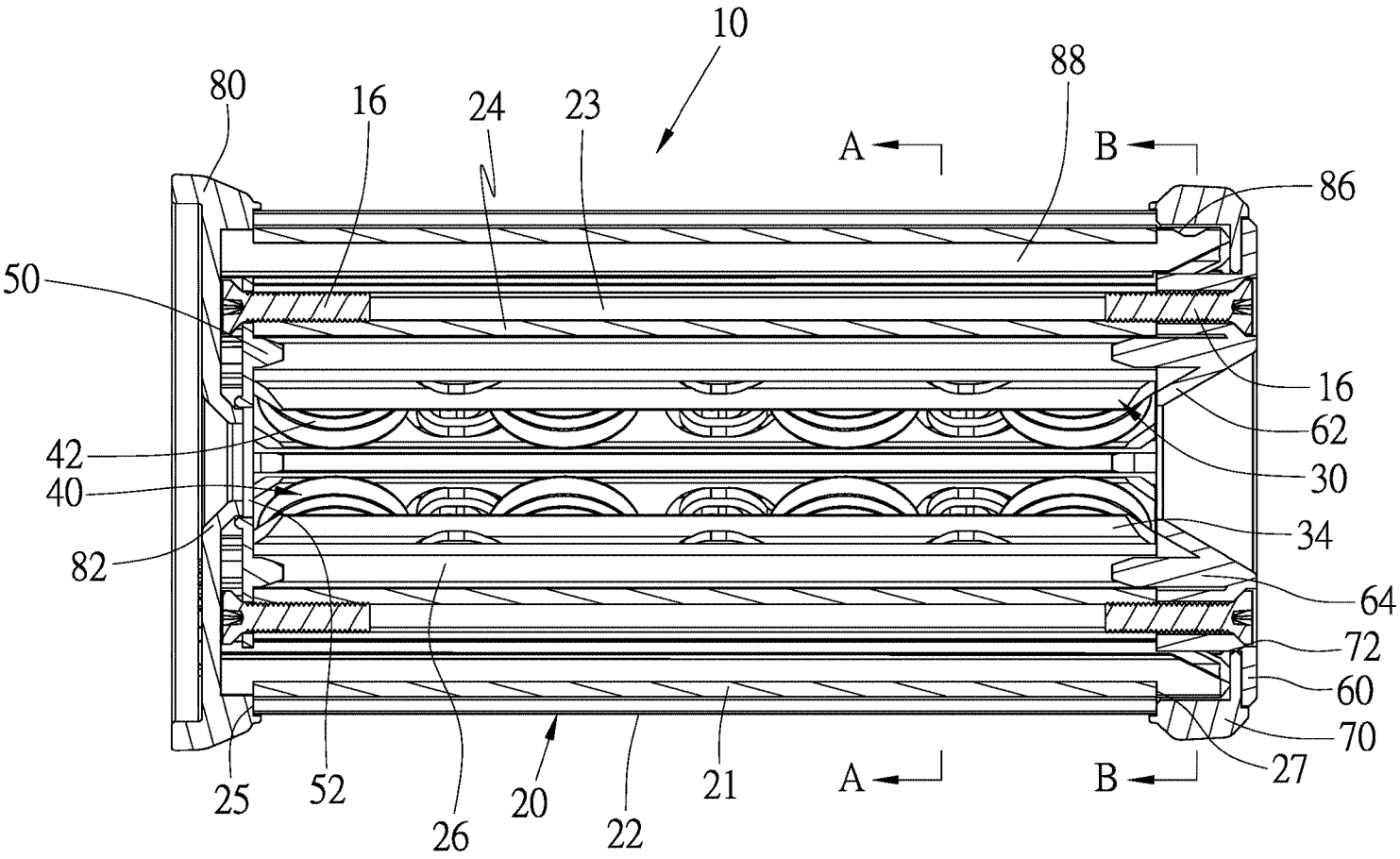
FIG. 4 is another cross-sectional view of the apparatus shown in FIG. 1.
Figure 7:
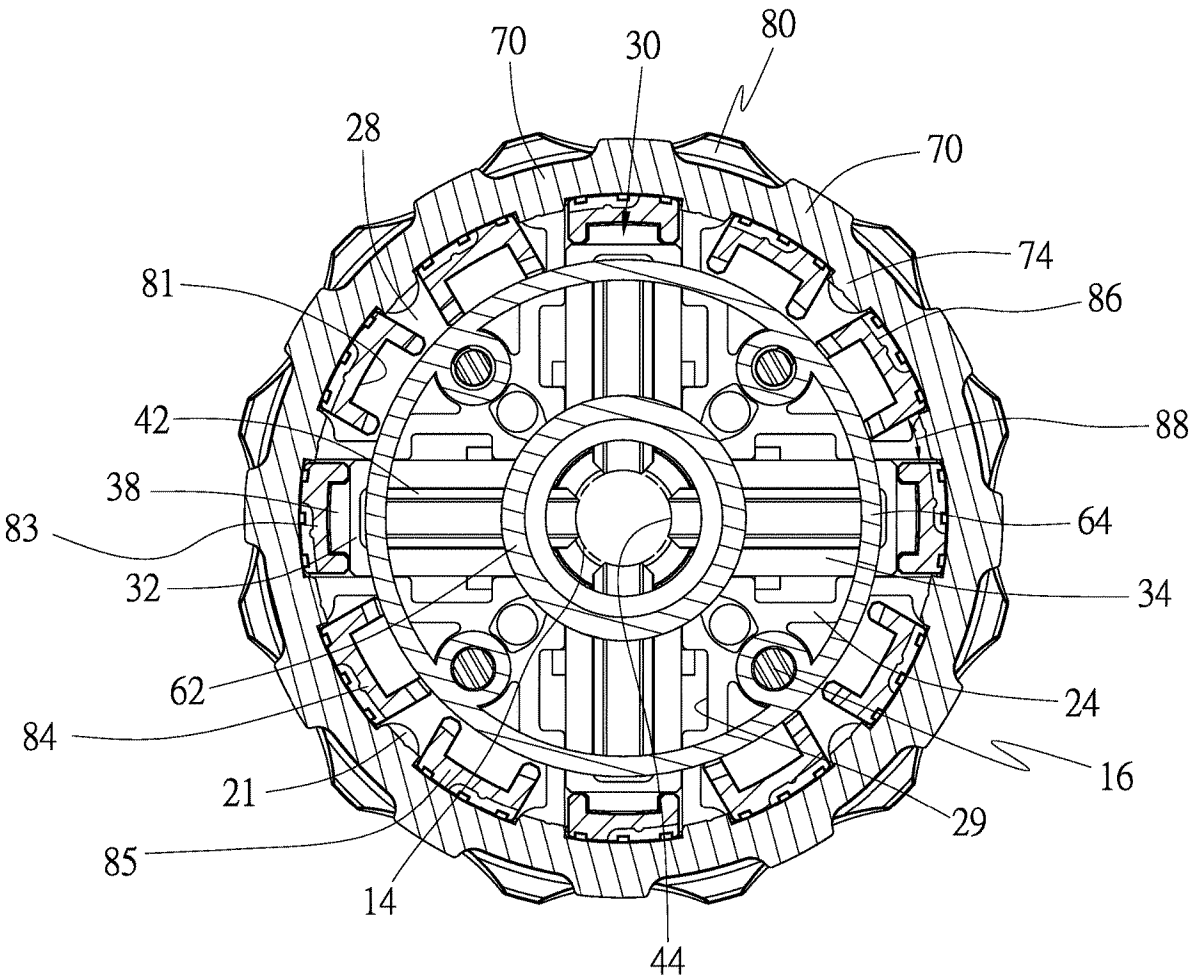
FIG. 7 is a cross-sectional view of the apparatus in another position than shown in FIG. 4.
Figure 8:
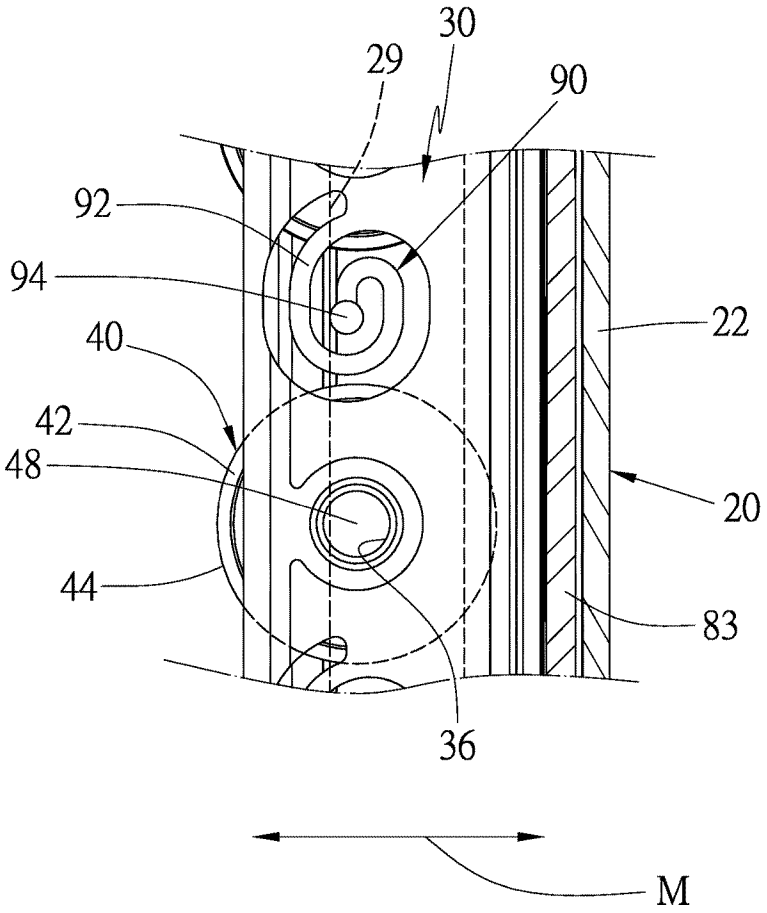
FIG. 8 is an enlarged partial view of the apparatus shown in FIG. 3.

Referring to FIGS. 4 and 7, the lock 70 is in the unlocking position. The bosses 74 are located out of the recesses 86 to allow detachment of the cover 80 from the shell 20.

Figure 9:
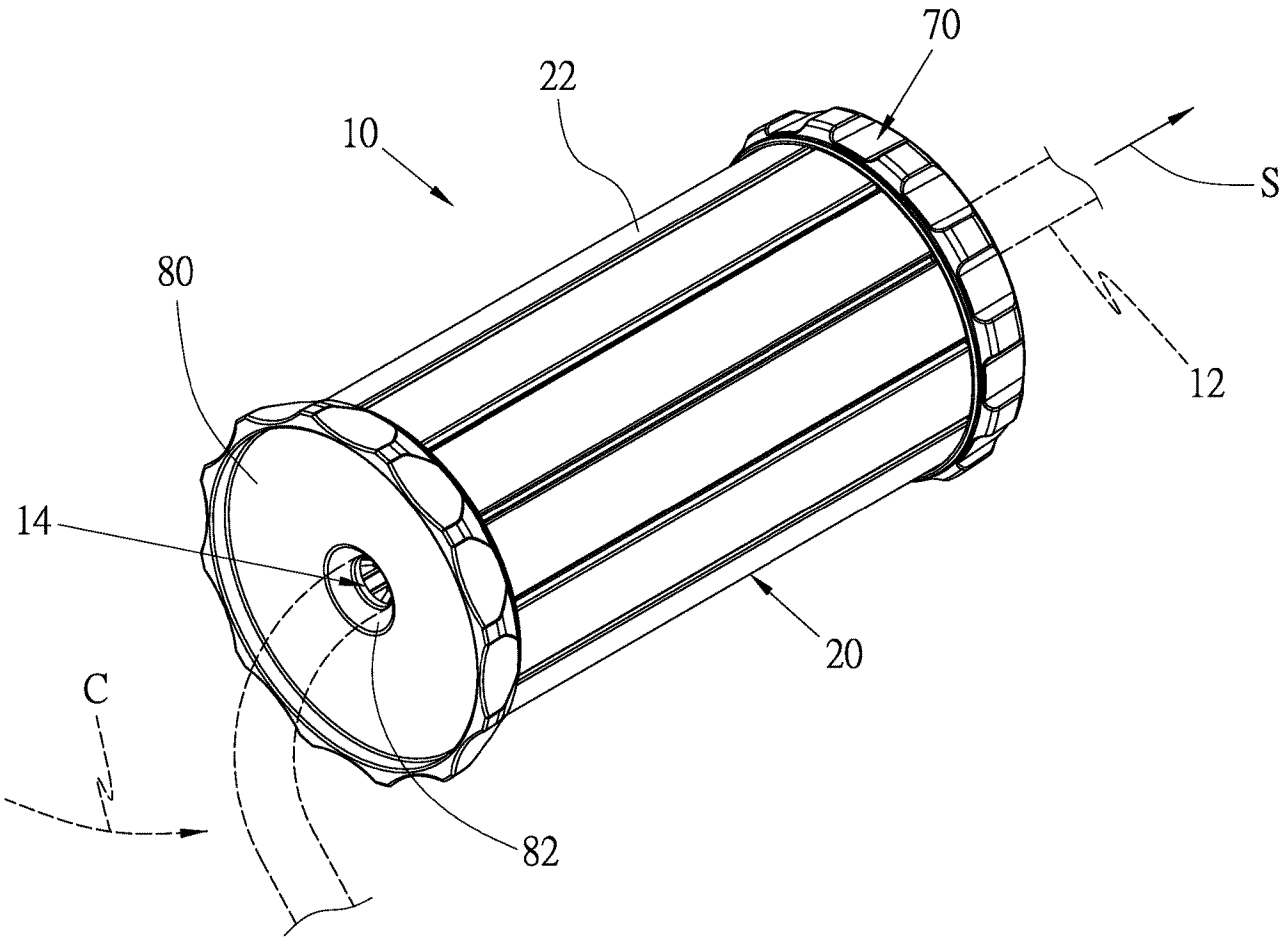
FIG. 9 is a perspective view of the apparatus shown in FIG. 1.

Referring to FIGS. 3 and 9, in a sense of direction indicated by an arrow head S, a first section of an elongated object 12 is inserted in the axial tunnel 14 via the countersink hole 82 of the cover 80. The first section of the elongated object 12 is moved out of the axial tunnel 14 via the funnel-shaped portion 62 of the ring 60.

A second section of the elongated object 12 is inserted in the axial tunnel 14. The second section of the elongated object 12 is in contact with the concave treads 44 of the rollers 42 of the roller sets 40.

A third section of the elongated object 12 is bent in a sense of direction as indicated by an arrow head C. Thus, the elongated object 12 can be smoothly bent to a desired angle. The elongated object 12 can be metal tube or a metal rod.

The back portions 32 of the sleds 30 are supported by the flank portions of the strips 83 and the fins 38 are inserted in the grooves 81 of the strips 83 if the diameter or external diameter of the elongated object 12 is large. The back portions 32 of the sleds 30 are supported by the flank portions of the strips 84 and the fins 38 are inserted in the grooves 81 of the strips 84 if the diameter or external diameter of the elongated object 12 is medium. The back portions 32 of the sleds 30 are placed against the flank portions of the strips 85 and the fins 38 are inserted in the grooves 81 of the strips 85 if the diameter or external diameter of the elongated object 12 is small. Thus, the apparatus 10 is useful for protectively holding elongated objects of various sizes.

Figure 10:
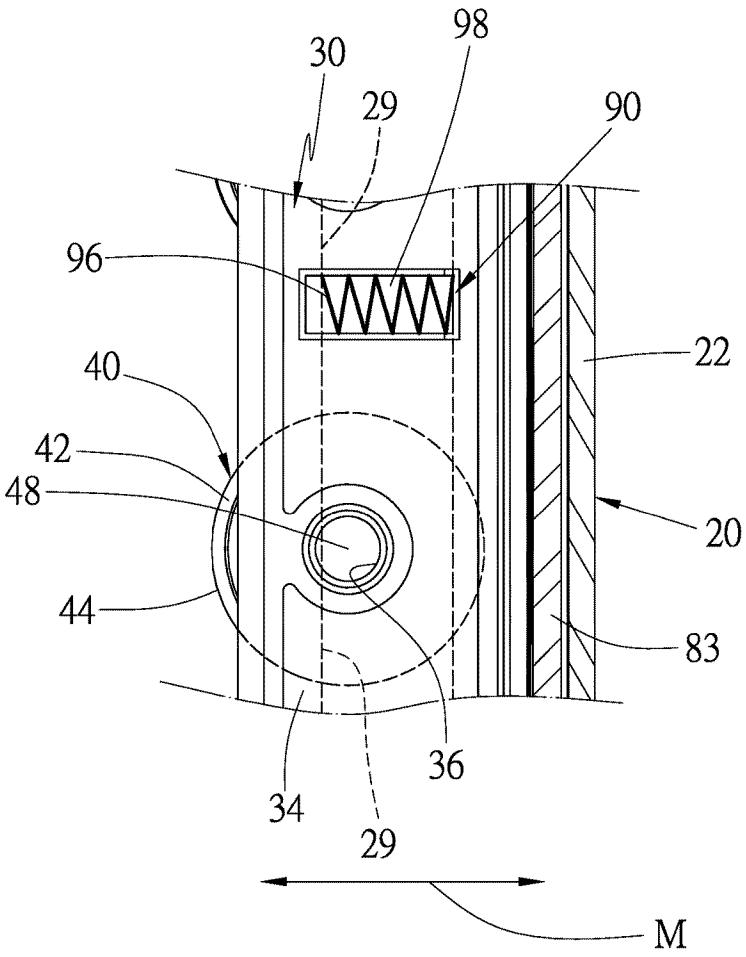
FIG. 10 is an enlarged partial cross-sectional view of an apparatus for protectively holding an elongated object during bending and stretching of the elongated object according to the second embodiment of the present invention.

Referring to FIG. 10, there is an apparatus 10 for protectively holding an elongated object 12 during bending and stretching of the elongated object 12 according to a second embodiment of the present invention. The second embodiment is identical to the first embodiment except for several things. Firstly, each sled 30 does not include any coil spring. Secondly, each flank portion 34 includes three grooves 98 near the flanges 29. Thirdly, compression springs 96 are used instead of the elastic elements 90. The compression springs 96 are inserted in the grooves 98. Each compression spring 96 includes an end abutted against the flanges 29 and another end in contact with a closed end of a corresponding groove 98. The elastic elements 90 can bias and hence turn the sleds 30 back to the normal position in the sense of direction indicated by the arrow head M.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. An apparatus for protectively holding an elongated object, the apparatus comprising:

a shell comprising a wall, support portions longitudinally extending on an internal face of the wall, and grooves separated from one another by the support portions;

sleds each inserted in a corresponding one of the grooves; and roller sets each comprising rollers attached to a corresponding one of the sleds, wherein each of the rollers comprises a tread so that the treads together provide an axial tunnel, and a surface of the elongated object is in contact with the treads of the rollers when the elongated object is rolled in the axial tunnel during bending or stretching of the elongated object.

2. The apparatus for protectively holding an elongated object according to claim 1, wherein the treads of the rollers are concave and together render the axial tunnel substantially circular in a cross-sectional view.

3. The apparatus for bending and stretching an elongated object according to claim 1, further comprising a first ring attached to an end of the shell and a second ring attached to another end of the shell to keep the sleds and the roller sets in the shell, wherein each of the first and second rings comprises a funnel-shaped portion in communication with the axial tunnel.

4. The apparatus for protectively holding an elongated object according to claim 3, further comprising a cover detachably connected to the shell to cover the first ring.

5. The apparatus for protectively holding an elongated object according to claim 4, wherein the cover comprises strip sets each comprising at least one strip extending throughout a corresponding one of the grooves and placed against a corresponding one of the sleds.

6. The apparatus for protectively holding an elongated object according to claim 5, wherein each of the strips comprises a groove, and each of the sleds comprises a fin inserted in a corresponding one of the grooves.

7. The apparatus for protectively holding an elongated object according to claim 5, further comprising a lock rotationally supported on the second ring between a locking position for locking the strips of the cover to the shell and an unlocking position for unlocking the strips of the cover relative to the shell.

8. The apparatus for protectively holding an elongated object according to claim 7, wherein each of the strips comprises a recess, and the lock comprises bosses inserted in the recesses when the lock is in the locking position and movable in slits between the strips when the lock is in the unlocking position.

9. The apparatus for protectively holding an elongated object according to claim 8, wherein the shell comprises peripheral tunnels each made in a corresponding one of the support portions, each of the strip sets comprises strips of various thickness, and a selected one of the strips of each of the strip sets extends throughout the grooves while the other strips of each of the strip sets extend throughout a corresponding one of the peripheral tunnels.

10. The apparatus for protectively holding an elongated object according to claim 9, wherein the shell comprises ribs each formed in a corresponding one of the peripheral tunnels and placed between the strips inserted in the corresponding peripheral tunnel.

11. The apparatus for protectively holding an elongated object according to claim 7, wherein the lock comprising a circular opening, and the second ring comprises an annular lip inserted in the circular opening of the lock to render the lock smoothly rotatable on the second ring.

12. The apparatus for protectively holding an elongated object according to claim 1, wherein the shell further comprises flanges for keeping the sleds in the grooves.

13. The apparatus for protectively holding an elongated object according to claim 12, further comprising elastic elements for biasing the sleds away from the flanges.

14. The apparatus for protectively holding an elongated object according to claim 13, wherein each of the elastic elements comprises a coil spring formed on the corresponding sled and a rod formed on the coil spring and abutted against the flanges.

15. The apparatus for protectively holding an elongated object according to claim 12, further comprising compression springs each comprising an end abutted against the corresponding sled and another end placed against the corresponding flanges.

* * * * *